US005415806A

United States Patent [19]

Pepe et al.

[11] Patent Number: 5,415,806

[45] Date of Patent: May 16, 1995

[54] COLD WATER SOLUBILITY FOR HIGH DENSITY DETERGENT POWDERS

[75] Inventors: Teri-Anne Pepe, Ramsey; John A. Hockey, Ridgewood; Daniel J. Fox, Tenafly, all of N.J.

[73] Assignee: Lever Brothers Company, Division of Conopco, Inc., New York, N.Y.

[21] Appl. No.: 159,177

[22] Filed: Nov. 30, 1993

Related U.S. Application Data

[63] Continuation-in-part of Ser. No. 29,266, Mar. 10, 1993, abandoned.

[51] Int. Cl.[6] ..... C11D 17/06

[52] U.S. Cl. ..... 252/174.21; 252/174; 252/174.23; 252/174.24; 252/174.25

[58] Field of Search ..... 252/174, 174.21, 174.23, 252/DIG. 2, 174.24, 174.25

[56] References Cited

U.S. PATENT DOCUMENTS

| | | | |
|---|---|---|---|
| 4,276,205 | 6/1981 | Ferry | 252/528 |
| 4,303,557 | 12/1981 | Rose | 252/527 |
| 4,379,080 | 4/1983 | Murphy | 252/526 |
| 4,490,271 | 12/1984 | Spadini et al. | 252/174.23 |
| 4,497,718 | 2/1985 | Neiditch et al. | 252/8.75 |
| 4,528,039 | 7/1985 | Rubin et al. | 252/135 |
| 4,652,391 | 3/1987 | Balk | 264/99 |
| 4,869,843 | 9/1989 | Saito et al. | 264/135 |
| 4,923,636 | 5/1990 | Blackburn et al. | 252/550 |
| 4,925,585 | 5/1990 | Strauss et al. | 264/89.1 |
| 4,970,017 | 11/1990 | Nakamura et al. | 264/174.13 |
| 4,992,198 | 2/1991 | Nebashi et al. | 252/174.11 |
| 4,999,138 | 3/1991 | Nebashi et al. | 264/543 |
| 5,009,804 | 4/1991 | Clayton et al. | 264/90 |
| 5,045,238 | 9/1991 | Jolicoeur et al. | 264/550 |
| 5,133,924 | 7/1992 | Appel et al. | 264/342 R |
| 5,164,108 | 11/1992 | Appel et al. | 252/174 |
| 5,219,549 | 6/1993 | Onda et al. | 423/415 P |
| 5,312,557 | 5/1994 | Onda et al. | 252/99 |
| 5,328,721 | 7/1994 | Giuilano et al. | 427/213 |
| 5,360,567 | 11/1994 | Fry et al. | 252/90 |

*Primary Examiner*—Paul Lieberman
*Assistant Examiner*—A. Hertzog
*Attorney, Agent, or Firm*—James J. Farrell

[57] ABSTRACT

This invention discloses a solubility aid for very high density powders of 650 g/L or greater density and having a low particle porosity of 25% or less. The solubility aid is a non-surfactant alkylene oxide condensate.

12 Claims, No Drawings

COLD WATER SOLUBILITY FOR HIGH DENSITY DETERGENT POWDERS

This is a continuation-in-part of prior application Ser. No. 08/029,266, filed on Mar. 10, 1993, and now abandoned.

FIELD OF THE INVENTION

This invention relates generally to high density detergent powders and to additives which, when coupled with the unique characteristics of these high density powders, improve their solubility.

BACKGROUND OF THE INVENTION

Among the first prerequisites for a powder laundry detergent is that it must dissolve completely in a relatively short time interval under whatever wash temperature and agitation conditions are employed in the wash cycle chosen by the consumer. Undissolved detergent not only fails to provide cleaning benefits, but also may become entrapped in the laundry articles and remain behind as a residue either in the machine or on the garments themselves. The problem of dispersion and solubilization in the wash cycle are made worse under conditions of cold water washing especially below about 50° F. and restricted or gentle agitation conditions. Both lower wash temperatures and milder agitation conditions are becoming ever increasing factors in today's washloads as both energy conservation and increased use of highly colored, delicate fabrics lead to wash conditions that make powders difficult to dissolve.

A particular problem arises with the use of high density laundry detergent powders; i.e., those with bulk densities 650 g/L or greater. Denser powders such as those of 800 g/L or higher are even more problematic. While these powders provide consumers the benefit of concentration and lower dosages, the processes required to produce high densities leave little or no void space in the detergent powder. See, for example, U.S. Pat. No. 5,133,924 which describes a process that reduces the intraparticle porosity so that void space is substantially decreased. These highly concentrated powders can prove difficult to dissolve since the powder has little or no free space to allow the entry of water necessary for dissolution. This, in turn, can result in the powder forming localized areas of gellation which remain undissolved at the end of the wash cycle and contribute to residue. Prior to the invention described herein, it does not appear that the problem of product residue has been satisfactorily resolved.

The inclusion of a non-surfactant solubility aid which is preferably a $C_2$–$C_4$ alkylene oxide condensation product increases the dissolution of high density powders with low intraparticle porosity and significantly reduces the potential for residue to remain behind. It is this improvement in the dissolving property of high density powders through the incorporation of solubility aids of specific molecular weights that forms the basis for the instant invention.

Spadini et al (U.S. Pat. No. 4,490,271) discloses the use of polyethylene glycols with polyacrylates of specified molecular weights to improve the removal of clay soils.

Murphy (U.S. Pat. No. 4,379,080)discloses the use of film forming polymers such as the copolymers of acrylic and maleic acid in a zeolite built powder to provide granules with free flowing characteristics and improved solubility.

Rose (U.S. Pat. No. 4,303,557) teaches the use of copolymers of maleic anhydride and vinyl alkyl ethers for use in zeolite containing detergents resulting in improved hard water detergency and providing granules with improved physical properties particularly improved breakdown resistance and reduced dustiness.

Ferry (U.S. Pat. No. 4,276,205) teaches the use of amine oxide surfactant in combination with alkyl phenol ethoxylates and alkylene oxide condensation products such as polyethylene glycol for use in providing superior detergency in cool or cold water fabric cycles.

SUMMARY OF THE INVENTION

The detergency process is dependent on the product having acceptable solubility and powder dispersion under all temperatures and wash conditions seen in consumer use. Under severe wash conditions, high density (650 g/L or greater) and particularly 800 g/L or greater laundry detergent powders may leave product residue upon completion of the wash cycle. This property is exaggerated in high density laundry detergent powders as compared to lower density (<650 g/L) products.

High Density can be produced by employing large quantities of highly dense material such as, for example, sodium carbonate. The intraparticle porosity of these powders may still be relatively high. High Density powders can also be produced by selected processes such as described in U.S. Pat. No. 5,133,924. In this patent intraparticle porosity is reduced in deformable particles to reduce the void space and increase the density. The fact that there is little or no intraparticle void space in these high density powders can result in localized gelling. This phenomenon can lead to increased product residue. The present invention encompasses high density laundry detergent compositions having intraparticle porosities of about 25% or less which are especially useful for improved solubility and dispersion properties, comprising:

a) from about 0.1% to about 10% preferably about 0.2% to 5% and most preferably 0.5% by weight of a non-surfactant solubility aid which is preferably a $C_2$-$C_4$ alkylene oxide condensation product having an average molecular weight of about 400 or greater, preferably 400 to 5,000. The most preferred aid for use in this invention are the polyethylene glycols. This component can either be added to the slurry or dosed in additional areas of the process such as a Lödige Recycler provided it is substantially homogeneously distributed throughout the particle.

b) Products have a bulk density of 650 g/L or greater and preferably 800 g/L or greater.

It has been determined empirically by the Product Entrapment Test described in Example 1 that a residue reduction of at least one third over the standard powder without the solubility aid is required to result in appropriate dissolution. The amount of residue remaining after the inventive product is employed is at least one third less than the amount of residue remaining after use of the standard powder without the solubility aid.

The essential detergent components described herein have been demonstrated to improve product solubility when included in high density laundry detergent powders having reduced void space and low intraparticle porosities. The powders can contain nonionic, anionic, and mixed active surfactant systems, builders including zeolites, polymers including acrylate/maleate copolymers, and other commonly used ingredients. A more specific description of these ingredients is given in the Detailed Description of the Invention. The low void space and intraparticle porosities described make it more difficult to dissolve the powder. Inclusion of the substantially homogeneously dispersed solubility aid acts to overcome the difficulty. Thus, although a powder having a density of 650 g/L benefits from use of the invention, it is believed that higher densities such as, for example, about 700 g/L or 800 g/L or greater will benefit even more.

DETAILED DESCRIPTION OF THE INVENTION

As mentioned above, if a high density powder leaves a residue, it is trapped in garments or leaves an unsightly residue in the machine. Low density powders, i.e., less than about 650 g/L do not typically have a residue.

As mentioned above, high density powders (650 g/L) can be difficult to dissolve, particularly in washing conditions that either limit the amount of water available to the powder or provide minimal thermal or mechanical energy associated with the wash cycle being used. These wash conditions are found in low temperature washes, gentle cycle (low agitation) washes, or those in which heavy garment loads are used which restrict the normal agitation in the system. The wash conditions cited which result in poor dissolving of powders are particularly critical in dissolving high density powders.

In the past, detergent powders in the U.S. were primarily made by spray drying processes. These processes produced low density (<400 g/L) powders which were "puffed" during the spray dried process, thereby providing very easy access to entry of wash water into the detergent particles. These spray dried powders have void spaces (i.e., open areas) of 40% or greater. Water could enter the particle and begin dissolving it even in conditions in which water was restricted or the wash cycle provided low energy content for dissolving solids. Recently, mid density (500 g/L) powders and a high density powder were introduced to the marketplace. The mid density powders are made by spray dried processes supplemented by additional process steps which act to increase the density but do not significantly reduce the void spaces and consequently dissolve very similarly to the low density powders. Very high density powders (950 g/L) experience problems in dissolving under poor wash conditions (i.e., wash conditions poor for dissolving substances as discussed above). In evaluating methods to solve the problem, attention was focused on accessibility of water into the particles. U.S. Pat. No.5,133,924 showed that high density powders produced by mechanical densification such as the Lodige recycler/plowshare system significantly reduced the void space in the powder to levels of 10% or less. This reduction in void space significantly reduces the likelihood that water will be able to penetrate the particle in sufficient quantity to dissolve it under poor dissolving conditions. Incorporation of very soluble material throughout the particle which begins to dissolve with the first contact with water can then act to further expand the available voids thus allowing more water to enter and rapidly dissolve the product, thus providing a solution to the problem.

Inherent in the provision of a rapid dissolving ingredient in the powder for improving solubility is the need to uniformly distribute this ingredient throughout the powder granule. This uniform distribution is necessary so that any void or crack in the particle surface that allows water to penetrate will be almost certain to contain the rapid dissolving ingredient, thereby resulting in improved solubility. AS shown in the U.S. Pat. No. 5,133,924, when the density of the particles prepared by mechanical densification processes gets above about 650 to 700 g/L or higher the void space rapidly declines to 25% or less which then inhibits particle dissolution. For very high density powders (800 g/L), the void space rapidly declines to 10% or less, greatly increasing this dissolving problem.

The combination of the addition of a rapid dissolving substance such as polyethylene glycol and the need for uniform dispersion of the substance within the high density granule are inherent parts of the inventive system used to improve the dissolving properties of high density powders.

we have found that for such high density powders a reduction in the residue of at least one third as measured by the Product Entrapment Test described below results in the significant benefit of this invention. The reduction contemplated is the reduction obtainable by comparing the powder both with and without the solubility aid.

The powder laundry detergents described in this invention contain the following components either as essential components or as optional ingredients: a Solubility aid, surfactants (either anionic, nonionic, cationic, zwitterionics or amphoterics or mixtures thereof) for detergency, builders for hardness ion sequestration, all of which are essential, agents for pH maintenance, enzymes (either protease, amylase, cellulase, lipases or mixtures thereof) for stain removal, fluorescent whitening agents for whitening and brightening of clothing, foam control agents, colorants, perfumes, bleaching agents (either chlorine or oxygen bleaching), soil release agents, anti-redeposition or soil suspending agents or other minor performance components may optionally be added. Each of these components, both essential and optional, are discussed in greater detail as follows:

Surfactants

While cationic, zwitterionic or amphoteric surfactants are acceptable for use and may be considered within the scope of this invention, anionic or nonionic surfactants and mixtures thereof are more commonly used in formulating laundry detergents. Suitable zwitterionics and amphoteric surfactants are as described in U.S. Pat. No. 4,528,039 while suitable cationic surfactants are described in U.S. Pat. No. 4,497,718. The surfactants described below are employed in amounts from about 1% to about 50% by weight of the total formula. Preferred surfactant levels are from 5% to about 40% and may consist of either a single surfactant or a mixture of the surfactants described below. Mixtures of anionic and nonionic surfactants may also be employed at varying levels, for example, up to 10% or 20% or even higher such as those disclosed in Blackburn et al. U.S. Pat. No. 4,923,636 incorporated by reference herein. The preferred anionic and nonionic surfactants are described in more detail as follows:

Anionics

Anionic surfactants comprise both soap based and synthetic detergents. The synthetic anionic detergents can be broadly described as the water-soluble salts of organic sulfur reaction products having in their molecular structure an alkyl radical containing from about 8 to about 22 carbon atoms and a radical selected from the group consisting of sulfonic acid and sulfuric acid ester radicals. Such surfactants are well known in the detergent art and are described in "Surface Active Agents and Detergents", Vol. II, by Schwartz, Perry and Berch. Among the more useful synthetic anionics are the alkyl, alkylaryl or alkenyl sulfonates and the alkyl and alkylene ethoxysulfates.

Suitable alkylaryl sulfonates include the alkali metal or the ammonium or alkanol ammonium salts of the alkyl aromatic sulfonates such as the higher alkyl benzene sulfonates containing from 10 to 16 carbon atoms in the alkyl group and a straight or branched chain. Especially valuable are linear straight chain alkylbenzene sulfonates in which the average number of carbon atoms in the alkyl group is from about 11 to about 15 carbon atoms. Other useful anionic sulfonates are the olefin sulfonates including long chain alkane sulfonates, long chain hydroxyalkane sulfonates or mixtures thereof, paraffin sulfonates, alkyl glyceryl sulfonates or mixtures of these sulfonates particularly with the linear alkyl benzene sulfonates.

Suitable alkyl sulfates such as primary or secondary alkyl sulfates include those in which the alkyl chain contains from about 10 to about 18 carbon atoms and the sulfate salt is formed by a solubilizing salt forming cation such as an alkali metal (such as sodium or potassium) or ammonium or alkanolammonium compounds such as the mono, di, or triethanol ammonium salt. Suitable alkyl ethoxy sulfates include those of the formula $RO(C_2H_4O)_nSO_3M$ where R is an alkyl preferably from $C_{10}$ to $C_{16}$ chain length, n is from 0.5 to about 6 and M is a solubilizing salt forming cation as described above for the alkyl sulfates.

Another anionic surfactant useful by itself or in combination with other surfactants for practice of this invention are soaps. Sodium or potassium soap are generally used with the fatty acid component of the soap derived from mixtures of saturated and partially unsaturated fatty acids in the $C_8$ to $C_{26}$ chain length region. The source of the fatty acid is traditionally a blend of coconut oil and tallow but may come from other sources such as palm oil, peanut oil, or sunflower seed oil.

The anionic surfactants as described above are employed in amounts from about 1% to about 30% by weight of the total formulation. Preferred anionic surfactant use levels are from about 2 to about 20% and may consist of either a single anionic surfactant or may be a mixture of the anionic described above.

Nonionics

Suitable nonionic surfactants are those of the formula $R(C_2H_4O)_nOH$ where R is a $C_8$ to $C_{18}$ carbon chain or a $C_8$ to $C_{12}$ alkyl phenyl group, and n is from about 2 to about 12. Examples of suitable linear, straight chain alkyl nonionics are the Neodols (ex Shell Chemical) and the Alfonics (ex Vista). Alkyl polyglycosides are also suitable. The nonionic surfactants as described above are employed in amounts from about 1% to about 30% by weight of the total formula. Preferred nonionic surfactant use levels are from about 3% to about 20% and may consist of either a single nonionic surfactant or may be a mixture of the nonionic described above.

Builders

Suitable builders useful in this invention include both organic and inorganic builders. Examples of suitable inorganic builders are the alkali metal salt of ortho, pyro, or tripolyphosphate, silicates, or zeolites. Examples of suitable organic builders include the alkali salts of ethylene diamine tetracetic acid, nitrolotriacetic acid and polycarboxylic acids such as citric acid. Other examples of suitable organic builders include carbonates, succinates and polymers and copolymers of maleic and acrylic acids. Preferred builders are the crystalline or amorphous zeolites either alone or in combination with a polymeric cobuilder such as the copolymers of acrylic and maleic acids.

The builders described above are employed in amounts from about 3% to about 60% by weight of the total formula. Preferred builder use levels are from about 5% to about 50% and may consist of either a single builder or may be a mixture of the builders described above. At least 10% builder is preferred.

Alkalinity Agents

While many of the builders cited above provide a source of alkalinity in addition to their primary function of water hardness sequestration, alkalinity agents are often used in addition to the builders to provide an alkalinity reservoir to maintain a high pH and saponify the acidic constituent of soil. Suitable alkalinity sources that may be used within the scope of this invention include alkali metal hydroxides, silicates, carbonates and mixtures thereof. The alkalinity agents as described above are used in amounts from 3% to about 60% by weight of the total formula. Preferred alkalinity agent use levels are from about 5% to about 50% and may consist of either a single alkalinity source or may be a mixture of the alkalinity agents described above.

Enzymes

The enzymes to be incorporated in this compound can be proteolytic, amylolytic, lypolytic and cellulolytic enzymes as well as mixtures thereof.

Particularly suitable enzymes are alkylene proteases obtained from strains of Bacillus, having maximum activity throughout the pH range from 7.0 to 12.0. The enzymes can be incorporated in any suitable form, i.e., as a granulate, marumes, or prills. Examples of proteolytic enzymes suitable for use in this invention are Alcalase, Savinase and Esperase sold by Novo-Nordisk Industries, Copenhagen, Denmark and Maxatase and Maxacal sold by Gist Brocades, Delft, Netherlands.

Among the $\alpha$-amylase enzymes suitable for use in this invention are Termamyl sold by Novo-Nordisk and Maxamyl sold by Gist Brocades.

Particularly suitable lipases include those fungal Lipases producible from Humicola lanuginosa and Thermomyces lanuginosus. The lipases can be incorporated in any suitable form i.e., as a granulate marume or prill. Examples of suitable lipases include Lipolase sold by Novo-Nordisk Industries.

Typical cellulases included hereunder are Celluzyme, a registered Trademark of Novo-Nordisk and KAC-500 a Trademark of Kao.

The amount of enzyme present in the composition will depend on the concentration of active enzyme in the specific product but will in general be used at a level from about 0.001 to about 10% by weight.

Fluorescent Whitening Agents

Among the fluorescent whitening agents suitable for use within the scope of this invention are the diaminostilbene disulfonate cyanuric chloride derivatives (DAS/CC).

The main constituents of the DAS/CC type fluorescent dyes are the 4,4'-bis[4-anilino-6-substituted-1,3,5 triazin-2-yl)amino]stilbene-2,2' disulfonic acids, or their alkali metal or alkanolamino salts, in which the substituted group is either morpholino, hydroxyethyl methylamino, dihydroxyethylamino or methylamino.

The fluorescent whitening agents most preferably used are those in which $R_1$ and $R_2$ are morpholino as in Tinopal AMS (ex Ciba Geigy), $R_1$ and $R_2$are hydroxyethyl-methylamino as in Tinopal 5BM (ex Ciba Geigy) or $R_1$ and $R_2$are dihydroxyethylamino as in Tinopal UNPA (ex Ciba Geigy). The fluorescent whitening agents described above are used in amounts from about 0.001% to about 2% by weight of the total formula. Preferred fluorescent whitening agent use levels are from about 0.01% to about 1% and may consist of either a single fluorescent whitener or may be a mixture of the fluorescent whiteners described above.

Solubility aid- Alkylene Oxide Condensation Product

An essential component of the present compositions is a non-surfactant solubility aid which is preferably a $C_2$–$C_4$ alkylene oxide condensation product having an average molecular weight of about 400 to about 5,000. The alkylene oxide condensation product can be represented by homopolymeric condensation products as well as by copolymers of alkylene oxide monomers with different carbon chain lengths. The monomers can include ethylene oxide, propylene oxide and butylene oxide. Suitable for use in the compositions of this invention are copolymers of ethylene and propylene oxides in varying molar ratios.

Highly preferred for use in the compositions of this invention are polyethylene glycols which, in fact, are homopolymers of ethylene oxide and having the generalized formula $$HO(CH_2CH_2O)_nH$$

n representing the average number of oxyethylene groups. Such compounds have a molecular weight of about 400 to 5,000, preferably from about 800 to about 5,000. It will be recognized that polyethylene glycol is sold in "nominal" or average molecular weight. These molecular weights are used herein. These compounds are well known and have been used in various industrial applications. The polyethylene glycols are available under a variety of commercial names. A very well known commercial name is Pluracol, followed by a number that roughly represents the average molecular weight, i.e., Pluracol 4000 represents a polymeric ethylene glycol having an average molecular weight of around 4000. Pluracol is manufactured by BASF. The polyethylene glycols known under the trade denomination Carbowax manufactured by Union Carbide Company is an additional example of the highly preferred alkylene oxide polymers used in the compositions.

The required level of the alkylene oxide condensation product is from about 0.1% to about 10% of the composition, preferably from about 0.2% to about 5% most preferably 0.5%. In some cases, the amount employed depends upon the method and point of its addition.

Optional Components

Among the optional components that can be used in this invention are foam control agents, colorants, processing aids, perfumes, bleaching agents, soil shield agents, antiredeposition or soil suspending materials, stain removal agents, color care ingredients, or other optional performance components.

A typical powder formulation is as follows:

A detergent powder composition having a density greater than 800 g/L and an intraparticle porosity of less than 10% consisting essentially of:

10 to 20% of an anionic surfactant
3 to 10% of a nonionic surfactant
15 to 40% of an inorganic non-phosphate builder
1 to 10% of a polycarboxylate builder
0.1 to 5% of a non-surfactant $C_2$–$C_4$ alkylene oxide condensation product as the sole solubility aid.

Formula Preparation

Base powder can suitably be prepared by mixing water plus detergent components in a slurry and spray drying this slurry. So long as substantially homogeneous distribution is accomplished, the alkylene oxide condensation product can be included in the slurry. Following spray drying, the base powder is densified by reducing intraparticle porosity and thus void space, typically by coupling two very different continuous mixers under selected process conditions, for example, those in U.S. Pat. No. 5,133,924 mentioned above, to yield a product with a density of 650 g/L or greater, preferably 800 g/L or greater. The higher density powders with lower porosity, of course, will also be suitable.

The first of these two mixers is typically a Recycler which can be supplied by Gebruder Lödige, a West German company. This Recycler is a high shear mixer CB-100 with a 350 horsepower motor attached. It has a variable frequency drive and pulley arrangements which can supply full power at three different shaft speeds; 600, 800, and 1000 RPMs. The powder residence time in this Recycler is approximately 10 seconds.

The second mixer is typically a KN-13500 Ploughshare mixer supplied with a 500 horsepower motor and a variable frequency drive by Littleford Brothers Incorporated. The Ploughshare is a low shear mixer that is predominately used to finish the densification, and to spheronize and granulate the product to the desired particle size. The powder residence time in the Ploughshare is a function of product throughput, mixer RPMs, and the discharge weir height. Particle size is also controlled by the residence time in the Ploughshare.

The intraparticle porosity required to benefit by the inclusion of the solubility aid of the invention is typically 25% or less, preferably 10% to 25% and most preferably 10% or less.

This process is fully described in Appel et al. U.S. Pat. No. 5,164,108 and U.S. Pat. No. 5,133,924, both of which are incorporated by reference herein.

Processes which do not employ spray drying are also applicable provided that substantially homogeneous distribution of the solubility aid is achieved.

The following compositions are used to illustrate the invention. All components are given in terms of weight percent of 100% active material unless specified otherwise.

EXAMPLE 1

Composition I is a commercially available, high-density laundry detergent powder that does not contain polyethylene glycol. Compositions II and III employ different weight percents of polyethylene glycol having a molecular weight of 1450 which are added to a high-density laundry detergent powder. In all cases the polyethylene glycol has been added to the slurry unless specified otherwise.

Compositions I–VI all have a bulk density of 650 g/L or greater. More specifically, 900 g/L ±50 g/L

| | COMPOSITION NUMBER | | |
|---|---|---|---|
| | I | II | III |
| Polyethylene Glycol | 0.0 | 0.2 | 0.5 |
| NaLAS-Sodium salt of a linear alkylbenzene sulfonic acid, where the alkyl chain length averages 13 carbon atoms | 13.26 | 13.26 | 13.26 |
| Ethoxylated $C_{12}$–$C_{15}$ alcohol, where the average number of ethoxylate groups per mole is 7 | 5.68 | 5.68 | 5.68 |
| Protease[1] | 0.85 | 0.85 | 0.85 |
| Lipase[2] | 0.60 | 0.60 | 0.60 |
| Sodium Carbonate | 32.10 | 32.10 | 32.10 |
| Sodium Aluminosilicate | 30.32 | 30.32 | 30.32 |
| Acrylate/Maleate Copolymer[3] | 2.37 | 2.37 | 2.37 |
| Silicone Antifoam | 0.004 | 0.004 | 0.004 |
| Water and Miscellaneous* ingredients | to 100 | to 100 | to 100 |

[1]Savinase 6.0T ® supplied by Novo-Nordisk Laboratories.
[2]Lipolase 100T ® supplied by Novo-Nordisk Laboratories.
[3]Molecular weight 70,000 acrylate:maleate copolymer (ratio is 3:1)
*Includes colorants, perfume, and fluorescer Compositions IV, V and VII examine various molecular weight polyethylene glycols, each added at a level of 0.5% by weight to a high density laundry detergent powder. Composition VI examines the Recycler as an alternate point of addition for the polyethylene glycol.

| | COMPOSITION NUMBER | | | |
|---|---|---|---|---|
| | IV | V | VI | VII |
| Polyethylene Glycol mol. wt. 400 | 0.5 | | | |
| Polyethylene Glycol mol. wt. 4000 | | 0.5 | | |
| Polyethylene Glycol mol. wt. 1450 | | | 0.5 | |
| Polyethylene Glycol mol. wt. 8000 | | | | 0.5 |
| NaLAS-Sodium salt of a linear alkylbenzene sulfonic acid, where the alkyl chain length averages 11 carbon atoms | 13.26 | 13.26 | 13.26 | 13.26 |
| Ethoxylated $C_{12}$–$C_{15}$ alcohol, where the average number of ethoxylate groups per mole is 7 | 5.68 | 5.68 | 5.68 | 5.68 |
| Protease | 0.85 | 0.85 | 0.85 | 0.85 |
| Lipase | 0.60 | 0.60 | 0.60 | 0.60 |
| Sodium Carbonate | 32.10 | 32.10 | 32.10 | 32.10 |
| Sodium Aluminosilicate | 30.32 | 30.32 | 30.32 | 30.32 |
| Acrylate/Maleate Copolymer[3] | 2.37 | 2.37 | 2.37 | 2.37 |
| Silicone Antifoam | 0.004 | 0.004 | 0.004 | 0.004 |
| Water and Miscellaneous* Ingredients | to 100 | to 100 | to 100 | to 100 |

[1]Savinase 6.0T ® supplied by Novo-Nordisk Laboratories.
[2]Lipolase 100T ® supplied by Novo-Nordisk Laboratories.
[3]Molecular weight 70000 acrylate:maleate copolymer (ratio is 3:1)
*Includes colorants, perfume, and fluorescer All compositions shown produced acceptable high density powders except for Composition VII (containing polyethylene glycol Mw=8,000) which could not be processed to form an acceptable detergent powder due to its failure to granulate. The above compositions were tested by the Product Entrapment Test for product solubility in washing machines which contained 5–7 pounds of denim ballast. The test involved adding a known amount (40 grams) of powder to a 5½in.×7½ in. Spun Dacron pouch and securing the pouch shut. The balance of the use level of product was added to the wash liquor.

The water temperature was kept constant at 5O° F., and the wash cycle was set to gentle. Upon completion of the wash, the residue in the pouch was dried to constant weight in a moderately heated (less than 160° F). oven and its weight was recorded in grams. A complete description of the Product Entrapment Test method is as follows:

1. Weigh a use level, that is the total amount of powder to be added to the load, into a container. Quantitatively transfer 40 grams of this product into a small beaker (beaker 1). Save the balance of the product in a separate beaker (beaker 2).
2. Quantitatively transfer a 40 gram sample from beaker 1 to the cloth pouch (5½in.×7½ in. spun dacron). Record the weight of the pouch plus the entire contents (initial weight). Secure the pouch shut.
3. Set the machine, for example, a Kenmore Heavy Duty 80 Series, or G.E. Heavy Duty extra capacity model, to the desired specifications. Add approximately 5-7 pounds of blue denim ballast to the washing machine. Fill the machine with water; i.e., complete cycle 1 of the wash cycle. Record the temperature of the washwater (approximately 5O° F).
4. After the machine is filled but before the agitation begins, place the pouch in the washing machine. Add the remainder of the powder from beaker 2 to the washwater.
5. Begin the wash cycle.
6. Upon completion of the entire wash cycle, dry the residue contained in the pouch to a constant weight in a moderately heated (less than 160° F). oven.
7. Record the weight of the dried residue in grams.

Test Results

1 Concentration

As shown below, the amount of product residue for composition II (0.2% MW 1450 PEG) and composition III (0.5% MW 1450 PEG) are superior to that for composition I(no PEG).

| Product | Grams Residue (out of 40) |
|---|---|
| I | 2.6 |
| II | 1.5 |
| III | 0.9 |

2. Molecular Weight and Point of Addition

Various molecular weight polyethylene glycols were examined, each at a level of 0.5% by weight. As shown below, the amount of product residue for compositions III, IV, and V (molecular weights 1450, 400, and 4000, respectively) are superior to that for composition I (0.0% PEG). There are no significant differences when the PEG is added to the Recycler (Composition VI) versus the slurry (Composition III).

| Product | Grams Residue (out of 40) |
|---|---|
| IV | 1.3 |
| V | 0.2 |
| VI | 0.6 |

Composition VII as mentioned above failed to granulate and thus was not tested.

3. Mid-Density: Commercially Available Product

| | Composition Number | | |
|---|---|---|---|
| | VIII | IX | X |
| Sodium salt of a linear $C_{12}$–$C_{13}$ alkylbenzene sulfonic acid | 13.9 | 15.0 | 0.0 |
| Sodium alkyl sulfate $C_{14}$–$C_{15}$ | 4.0 | 0.0 | 0.0 |
| Ethoxylated $C_{12}$–$C_{15}$ alcohol, where the average number of ethoxylate groups per mole is 13 | 0.0 | 4.0 | 13.5 |
| Ethoxylated $C_{12}$–$C_{15}$ alcohol, where the average number of ethoxylate groups per mole is 7 | 0.0 | 4.0 | 0.0 |
| Other nonionics (Carbowax, polyethylene glycol MW 8000) long chain alcohol, and some hydrocarbon) | 0.7 | 0.0 | 0.0 |
| Protease | 0.6 | 0.96[1] | 0.0 |
| Lipase[2] | 0.0 | 0.68 | 0.0 |
| Sodium Carbonate | 21.5 | 19.5 | 38.5 |
| Sodium Aluminosilicates | 27.8 | 38.0 | 1.0 |
| Sodium sulfate | 12.1 | 8.1 | 29.23 |
| Polymer | 3.3 | 0.5 | 1.0 |
| Citric acid | 2.8 | 0.0 | 0.0 |
| Sodium Citrate | 0.0 | 2.5 | 0.0 |
| Sodium silicate | 1.6 | 0.5 | 11.6 |
| Hydroxypropyl methycellulose | 0.0 | 0.0 | 0.12 |
| Water and Miscellaneous[3] Ingredients | to 100 | to 100 | to 100 |

[1]Savinase 6.0T ® supplied by Novo-Nordisk Laboratories.
[2]Lipolase 100T ® supplied by Novo-Nordisk Laboratories.
[3]Includes colorants, perfume, fluorescer, and silicone antifoam Compositions VIII, IX, and X are commercially available powder laundry detergents with bulk densities less than 650 g/L. Composition VIII does not contain nonionic surfactants, Composition IX contains both nonionic and anionic surfactants, and Composition X does not contain anionic surfactants. All three mid-density products left virtually no residue under all wash conditions and temperatures.

It is understood that the examples and embodiments described herein are for illustrative purposes only and that various modifications or changes in the light thereof will be suggested to persons skilled in the art and are to be included within the spirit and purview of this application and the scope of the appended claims.

What is claimed is:

1. A detergent composition having an intraparticle porosity of 25% or less and a density of at least 650 g/L consisting essentially of:

a. at least 5 wt. % of a surfactant selected from the group consisting of anionic, nonionic, cationic, zwitterionic surfactants and mixtures thereof;

b. at least 10 wt. % of a builder and c. having substantially homogeneously distributed therein as the sole solubility aid, about 0.1 to 0.5 wt. % of a polyethylene glycol having a molecular weight of about 400 to 5000.

2. A detergent composition as defined in claim 1, in which the bulk density of the composition is at least 800 g/L.

3. A detergent composition as defined in claim 1 prepared by a process comprising substantially homogeneously distributing said solubility aid in said composition.

4. A detergent composition as defined in claim 3 prepared in a spray tower in which the solubility aid is added to the spray tower slurry.

5. A detergent composition as defined in claim 1 which contains both anionic and nonionic surfactant at a total surfactant level of 10 wt. % or greater.

6. A detergent composition as defined in claim 5 in which the bulk density is 800 g/L or greater.

7. A detergent composition as defined in claim 6 wherein said builder is non-phosphate.

8. A detergent composition as defined in claim 1 wherein the intraparticle porosity is about 10% to 25%.

9. A detergent composition as defined in claim 1 having intraparticle porosity of less than 10%.

10. A detergent composition as defined in claim 1 having a density of 800 g/L or higher and an intraparticle porosity of 10% or less.

11. A method for cleaning fabrics by the use of the detergent composition of claim 1 comprising contacting the fabrics with said composition, in wash cycles in which the temperature is 50° F. or less.

12. A detergent powder composition having a density greater than 800 g/L and an intraparticle porosity of less than 10% consisting essentially of:

10 to 20 wt. % of an anionic surfactant 3 to 10 wt. % of a nonanionic surfactant 15 to 40 wt. % of an inorganic non-phosphate builder 1 to 10% of a polycarboxylate builder 0.1 to 0.5 wt. % of a polyethylene glycol having a molecular weight of about 400 to 5000 as the sole solubility aid.

* * * * *